United States Patent [19]

Weissman

[11] 4,063,938

[45] Dec. 20, 1977

[54] METHOD FOR PRODUCING A NITRIDE BASED HARD METAL POWDER

[76] Inventor: Gerd Weissman, Friedrich-Eckart-Strasse 21, 8000 Munich 81, Germany

[21] Appl. No.: 562,541

[22] Filed: Mar. 27, 1975

[30] Foreign Application Priority Data

Mar. 30, 1974 Germany ..... 2415553

[51] Int. Cl.[2] ..... B22F 1/00

[52] U.S. Cl. ..... 75/205; 148/126; 75/211

[58] Field of Search ..... 29/182.5; 75/205, 211; 148/126

[56] References Cited

U.S. PATENT DOCUMENTS

| | | | |
|---|---|---|---|
| 3,011,927 | 12/1961 | Zelezny | 148/126 |
| 3,459,546 | 8/1969 | Lambert | 75/205 |
| 3,615,380 | 10/1971 | Fichte et al. | 148/126 |
| 3,741,733 | 6/1973 | Kieffer | 75/205 |
| 3,880,600 | 4/1975 | Zboril | 148/126 |
| 3,904,448 | 9/1975 | Takahashi et al. | 148/126 |

*Primary Examiner*—Brooks H. Hunt

[57] ABSTRACT

Hard metal carbide alloys are produced by nitriding a mixture of finely divided refractory metals selected from group VI of the periodic table of elements, a refractory metal selected from group IV and V of the periodic table of elements and a metal selected from the iron group, under temperatures below 1250° for a time less than 12 hours.

18 Claims, No Drawings

METHOD FOR PRODUCING A NITRIDE BASED HARD METAL POWDER

BACKGROUND OF THE INVENTION

The present invention relates to a method for the production of nitride based hard metallid alloys from powders containing a auxiliary metal and a refractory metal chosen from the VI group of the periodic system of the elements.

The increased use of high temperature materials in industrial construction places increasing demand on the cutting tools required for machining such materials. It has been attempted to meet these demands by the production of newer hard carbide alloys. In this connection, the tendency has been toward the employment of even harder alloys. This presents a serious problem in that as a result such alloys have correspondingly increasingly low elasticity. To overcome this problem, experiments have been conducted which, instead of using as the hard material component of the alloy the conventional carbides of the metals of groups IVa, Va and VIa of the periodic system of elements, the nitrides and carbonitrides of these elements were used. It has been found that such nitrides and/or carbonnitrides do not in fact attain the hardness of the more conventional corresponding carbides although they surpass the latter in elasticity. What is more, alloys of such materials, when used as cutting tools, have a lower tendency to weld to the chips or shavings removed from the workpiece.

It was furthermore known that only carbonitrides, having a defined nitrogen to carbon ratio, display a suitable combination of hardness and elasticity. Such carbonitrides, and nitrides, nevertheless, have the drawback of being present, in the alloy, at least superficially as oxy-carbonitrides, which are extremely stable and thus very badly wetted by the alloys forming the auxiliary metal phase. As a result brittle sintered metal carbide bodies are formed.

Such further efforts have been made to improve the wettability of nitride based carbide materials. One such process, disclosed in German publication DAS 2,005,707, attempted to improve wettability of hard metal powders by coating the grains of the powder with a layer of metal carbide which would be easily and sufficiently wetted by the binder metals used in the ultimate alloy.

A second process, disclosed in German publication OS 2,043,411, employs as a starting material nitrides and carbonitrides which are low in oxygen. Such low oxygen nitrides are best obtained from pure metal components of from the corresponding metal hydrides and purified nitrogen. In this process, the temperatures required to form the nitrides is between 1400° and 1800° centigrade. Low oxygen carbonitrides are produced from the reaction of the nitrides thus obtained and vacuum purified carbides, at temperatures of the same order of magnitude. Notwithstanding, the nitride and carbonitride starting materials, obtained by this latter process, always contain remnants of oxygen which must be removed. Removal of the oxygen entails subjecting the material to a refining annealing treatment in the presence of metals, of the chromium group, which metals have a deoxidizing effect. It is only when the nitride or carbonitride materials are finally combined with auxiliary metal alloys containing metals from the iron group and metals from the VI group, that a satisfactory hard metal carbide alloy is obtained. This process therefore has the further drawback in that, in order to produce a serviceable hard material component, at least two high temperature reactions are necessary. This makes the process costly and time consuming. Consequently, like the first described process, wherein the nitrides are coated, the second process has not met wide acceptance, commercial success or widespread technical use.

It is an object of the present invention to overcome said drawbacks and insufficiencies by providing an improved method for producing a hard metal nitride based powder for manufacturing hard metal alloys.

It is another object of the present invention to provide a method for producing hard metal alloys having improved strength and hardness characteristics combined with improved characteristics of elasticity and ductility.

It is another object of the present invention to provide a method for producing hard metal alloys containing a nitride based alloy and an auxiliary metal.

It is still another object of the present invention to provide a method for producing a hard metal nitride based alloy in presence of refractory metals of the VI group of the periodic system of elements.

Still another object of the present invention is to provide a method for producing hard alloys from metal carbide powders, a nitride based auxiliary metal of the IV and/or the V group of the periodic system of elements or from a mixture of these refractory metals by nitridation in presence of refractory metals of the VI group of the periodic system of elements and of a finely distributed powder of metals of the iron group.

It is also an object of the invention to provide a method for producing said hard metal powder in a simple and relatively low-cost procedure.

The foregoing objects together with other objects and advantages of the present invention will be found in the following disclosure of the present invention.

DESCRIPTION OF THE INVENTION

According to the present invention hard metal alloys are produced by reacting a mixture of finely divided refractory metals (A) selected from the VI group of the periodic table of elements, a refractory metal (B) selected from the IV and/or V groups of the periodic table of elements and a metal (C) from the iron group, in a gaseous media containing nitrogen until the mixture is nitrided and the hard metal alloy is formed.

The mixture may be combined dry, or with organic solvents such as benzene, ethanol or cyclohexane.

The invention is based on the surprising discovery, which is itself inventive, that nitriding refractory metals in presence of a metal of the iron group at a relatively low temperature and in a short reaction period, results in the formation of nitrides having only a theoretical nitrogen content. These nitrides prove to have, when sintered, a good wettability or cross-linking property. The ability to easily and relatively swiftly obtain these results stems, inventively, from the simultaneous mixing of a refractory metal of the IV or V group of the periodic system of elements, and/or their mixtures with a refractory metal of the VI group of the periodic system of elements and a metal of the iron group, and reacting the mixture with a gaseous medium containing nitrogen.

The reaction is carried out at a temperature within the range of 600° and 1250° C for periods of 1 - 12 hous depending on the temperature. This temperature range is substantially lower than that employed in the prodedures which have been known hitherto. Hence, the process of the invention provides a considerably lower technical expenditure, i.e. less work and less cost and for the first time enables the making of hard material component directly in presence of the auxiliary metallic component which conventionally comprises metals of the iron group, which temselves melt at, or about, the temperature of 1500° C.

On completion of the nitriding reaction which is simple compared to the prior processes, a substantially finished hard metal powder alloy is thus readily available. The present invention is consequently more suitable than the older processes for broad technical and commercial application.

The refractory metals are chosen from those found in group VI of the periodic table of elements and may include chromium, molybdenum, and tungsten. The refractory metals are chosen from the groups IV and V of the periodic table of elements and include, but are not limited to titanium, zirconium, hafnium, vanadium, niobium and tantalum. The metals of the iron group can be iron, nickel and cobalt.

Nitriding can be carried out at normal (atmospheric or ambient) pressures, or at elevated pressures in fixed, movable (vortex or mixing mills) or fluidized bed of conventional form. It may also be carried out under negative pressures (partial or complete vacuum) in suitable conventionally moving or fluidized beds.

In addition to the single stage reaction, nitriding may be carried out in two stages. In such a modification, the first stage may extend over a period of 1 to 6 hours and at a temperature of 600° to 900° C, while the second stage may extend over a period of 1 to 12 hours at a temperature of between 900° to 1250° C. Preferably, the first stage need last only 2 - 4 hours and not exceed 900° C while the second stage need last only 2 - 6 hours at a temperature between 1000° - 1100° C. It is particularly advantageous to introduce the gaseous medium in the first stage at ambient pressures and in the second stage under elevated pressures between 1 to 20 atmospheres. A suitable gaseous media containing nitrogen may be $NH_3$, which is disproportioning under the catalytic action of the finely divided auxiliary metal. Through the use of $NH_3$, reactive (statu nascendi) nitrogen is obtained to such an increased extent, in the presence of the hydrogen, so that the oxide content is significantly reduced. Other nitrogen containing gases, that may be employed, are $N_2$ and prussic acid. Preferably, the gases are purified.

Since the wettability and certain other physical properties, e.g. melting point, electric conductivity and resistance to wear of the nitrides are improved by incorporating carbon, i.e. through the formation of nitride-carbide mixed crystals, the present invention has the advantage over the prior art in being able to produce determined amounts of such carbonitrides by introducing a carbon containing gas, before, during and/or after nitriding. The desired ratio between nitrogen and carbon in the carbonitrides can be regulated by controlling the composition of the gas phase or by limiting the period of time the gas is fed to the reaction media.

On the other hand, grains or particulate powder of pure nitride may be formed with a readily wettable outer layer or coating of carbonitride by first performing the reaction in the two stages described above and thereafter replacing the gas containing nitrogen with a gas containing carbon so that a partial breakdown occurs of the nitrogen in the outer layer allowing the simultaneous incorporation of the carbon. This process is much simpler than the conventional process of coating with metal carbides.

A gas comprising both nitrogen and carbon, such as methylamine may also be used. Methylamine is advantageous, because it readily decomposes and because it contains equal quantities of carbon and nitrogen. Besides, as viewed from the point of atomic percentage, methylamine has less hydrogen than any other aminohydrocarbons.

The finely divided metal preparations may also contain finely divided dimetallic carbides of the transition metals of groups V or VI of the periodic table of elements and/or monometal carbides of these transition metals. Through the action of the nitrogen gas or the gas containing nitrogen, the dimetallic carbides, nevertheless, react through the incorporation of the nitrogen to form carbonitrides having a C/N ratio of at least 50%. The presence of small quantities of free carbides, however, enhances the hardness of the carbonitrides.

The hard metal carbide alloys made by the present invention may be processed by any of the conventional and known methods of powder metallurgy. They may be subjected to sintering, compression, molding, etc. as any of the known powder alloys to form shaped bodies of any desired configuration. They may be employed alone, or mixed or ground together with other powder alloys of auxiliary (iron) or carbide materials.

The starting metal materials may be finely divided into grannular, powder or similar form by conventional grinding apparatus, ball mills, etc., either separately before mixture, or simultaneously after mixture. Preferably, the material is reduced to finely divided size below 50 micron, preferably between 1 and 5 microns prior to mixture or nitriding in accordacne with the process. The mixture of finely divided materials may be loosely agglomerated and maintained in grannular form during nitriding or carbonitriding. However, they may be compressed or molded into desired shape and thereafter nitrided or carbonitrided.

EXAMPLES

Particular details of the present invention are set forth in the following illustrative examples, wherein the relative proportions are indicated as parts per weight, unless otherwise indicated:

EXAMPLE 1

85 Parts of Ti, 15 parts of Mo and 15 parts of Ni, each previously comminuted into finely divided form was mixed in a closed reaction vessel having a bed supported on a porous bottom. The mixture was heated under high vacuum (approx. 10-5 Torr) to 800° C. The mixture was then maintained at this temperature for 2 hours during which time purified $NH_3$ was introduced under normal or ambient pressure through the sieve bottom of the reaction vessel. Thereafter, the vessel was further heated to increase the temperature of the mixture to 1100° C. This temperature was maintained for 4 hours during which under high pressure in excess of 5 atm, a gaseous mixture was introduced comprising $N_2$ and $CH_4$ in a ratio of 5 parts by volume of $N_2$ to 1 part by volume of $CH_4$. The reaction product, a powder alloy, contained, by chemical analysis 12.5% of $N_2$ and 3.4% of C. The powder was removed from the vessel and compressed into desired shape. Thereafter, the shaped body was presintered at 900° C for 30 minutes under a blanket of $NH_3$, after which complete sintering was carried out in vacuum of $10^{-1}$ torr. for 2 hours at the temperature of 1350° C. The resulting was polished and conventionally finished. The body had a hardness of 1450–1500 HV2 (as tested by the Vickers hardness procedure) and had a bending flexing strength against breaking of 100–120 kp/mm².

EXAMPLE 2

A powdered mixture of 24 parts of Ti, 34.8 parts of TiC, 14.4 parts of Ni, 18.8 parts of Mo, 2 parts of Cr and 10 parts of Ta and of an organic solvent were introduced into a planetary ball mill. Said mixture was therein treated to form a fluidous granulate having good flow characteristics. This granulate was thereafter heated to 750° C in an inductively heated fluidized bed reactor under purified $N_2$ atmosphere for a period of 1 hours. Thereafter the temperature of the mixture was increased at the rate of 5° per min. to 1100° C. This temperature was maintained in the fluidized bed reactor for 3 hours during which the $N_2$ was continually introduced. Thereafter, the mixture was cooled under an $N_2$ atmosphere. The cooled granulate product was removed from the reactor and compressed by conventional methods. The compressed body was sintered at the temperature of 1450° C, under a blanket of $N_2$ at a pressure of 1 atm, for 45 minutes. A sample piece, after polishing and finishing was tested and proved to have the hardness of 1400 HV 2 and the bending strength of 120–130 kp/mm², under the procedures of Example 1.

EXAMPLE 3

A mixture was prepared containing 33 parts of Ti, 14 parts of Ta, 5.6 parts of Hf, 5 parts of W, 1 $Cr_3C_2$ 12 Mo, 12 parts of Ni and 5 parts of Co. The mixture was introduced into a rotary tube furnace and heated to 850° C. A gaseous medium of $N_2$ was blown over the mixture and this treatment was continued for 4 hours during which time the mixture was pre-nitrided. The hard metal powder thus obtained was further ground for a short time in the ball mill and then compressed and molded to form the desired bodies therefrom. The molded bodies were thereafter heated in a vacuum furnace to 1100° C for 3 hours under 400 torr during which time methylamine was introduced in contact with the body and caused to react therewith. Then the reaction gas was exhausted by pumping and sintering was carried out under a vacuum of $10^{-2}$ torr at the temperature of 1400° C during 1 hour. The body was thereafter polished and finished.

Suitable cutting tools, such as blades, drill bits, and the like were produced from each of the alloys produced from Examples 1 through 3.

What is claimed is:

1. A method for nitriding refractory metals for the production of low oxygen nitride based hard metal alloys comprising the steps of admixing (A) a finely divided metal selected from the group consisting of the VI group of the periodic table of elements, (B) a finely divided refractory metal selected from the group consisting of metals of the IV or V groups of the periodic table of elements or mixtures thereof and (C) a finely divided auxiliary metal selected from the group consisting of the iron metals, and reacting said mixture with a gas containing nitrogen at a temperature and time sufficient to nitride said mixture.

2. The method of claim 1 wherein said gas containing nitrogen is selected from the group consisting of $NH_3$, $N_2$.

3. The method of claim 1 wherein said unit (C) is selected from the group consisting of iron, nickel, cobalt.

4. The method of claim 1 wherein said unit (B) is selected from the group IV or V consisting of titanium, zirconium, hafnium vanadium, Niobium and tantalum.

5. The method of claim 1 wherein said unit (A) is selected from the group consisting of chromium molybdenum, and tungsten.

6. The method of claim 1 wherein the mixture includes dimetallic carbides selected from the group consisting of the refractory metals of group V and VI of the periodic table of elements, and the mon-carbides of the refractory metals of groups IV, V and VI of the periodic table of elements or their mixtures.

7. The method of claim 1, wherein the reaction is carried out at the temperature of between 600° and 1250° C.

8. The method of claim 7, in which the reaction is carried out in two consecutive stages, the first stage being performed during the period of 1 to 6 hours, at the temperature of between 600° and 900° C, while the second stage is performed during the period of 1 to 12 hours, at the temperature of 900° to 1250° C.

9. The method according to claim 8 wherein the reaction of the first stage is carried out for a period of between 2 - 4 hours at a temperature of between 700° - 800° C and the reaction of the second stage is carried out for a period of between 2 - 6 hours at a temperature between 1000° - 1100° C.

10. The method according to claim 1, wherein in the first stage a nitrogen containing gas is employed having a disproportionating effect under the catalytic influence of the finely distributed auxiliary metals of the iron group, and in the second stage a nitrogen containing gas is introduced under a pressure of between 1 and 20 atm.

11. The method according to claim 10 wherein said nitrogen containing gas is $NH_3$.

12. The method of claim 1, in which a carboneous gas is introduced in the mixture during said reaction.

13. The method of claim 12, in which the carboneous gas is introduced before nitriding.

14. The method of claim 12, in which the carboneous gas is introduced during nitriding.

15. The method of claim 12, in which the carboneous gas is introduced after nitriding.

16. The method of claim 12, in which the carboneous gas is methane.

17. The method of claim 1, in which said nitrogen containing gas is methylamine.

18. The method of producing a hard metal alloy comprising the steps of forming a nitrided reaction product of an admixture of (A) a finely divided metal selected from the group consisting of the VI group of the periodic table of elements, (B) a finely divided refractory metal selected from the group consisting of metals of the IV or V groups of the periodic table of elements or mixtures thereof and (C) a finely divided auxiliary metal selected from the group consisting of the iron metals by reacting said admixture with a gas containing nitrogen at a temperature and time sufficient to nitride said admixture, and thereafter sintering said reaction product.

* * * * *